United States Patent [19]

McNeil

[11] Patent Number: 4,482,157

[45] Date of Patent: Nov. 13, 1984

[54] TIP BALL GAME

[76] Inventor: Algernon McNeil, 327 Finch St., Wilson, N.C. 27893

[21] Appl. No.: 432,692

[22] Filed: Feb. 2, 1983

[51] Int. Cl.³ ..... A63B 71/02

[52] U.S. Cl. ..... 273/411

[58] Field of Search ..... 273/411

[56] References Cited

U.S. PATENT DOCUMENTS

| | | | |
|---|---|---|---|
| 2,545,615 | 3/1951 | Hatley | 273/411 X |
| 2,580,799 | 1/1952 | Lauterbach | 273/411 X |
| 3,602,505 | 8/1971 | Friend | 273/411 X |

FOREIGN PATENT DOCUMENTS

| | | | |
|---|---|---|---|
| 470279 | 12/1950 | Canada | 273/411 |

*Primary Examiner*—William H. Grieb

*Attorney, Agent, or Firm*—Mills and Coats

[57] ABSTRACT

This invention is a game which is a combination of basic basketball, football, volleyball and soccer. This combination is so designed to show the beauty of each sport as well as providing recreational exercise. Total athletic skills are displayed in the game and more people are given the chance to participate since it is so designed that a small person can participate as well as a large person.

7 Claims, 1 Drawing Figure

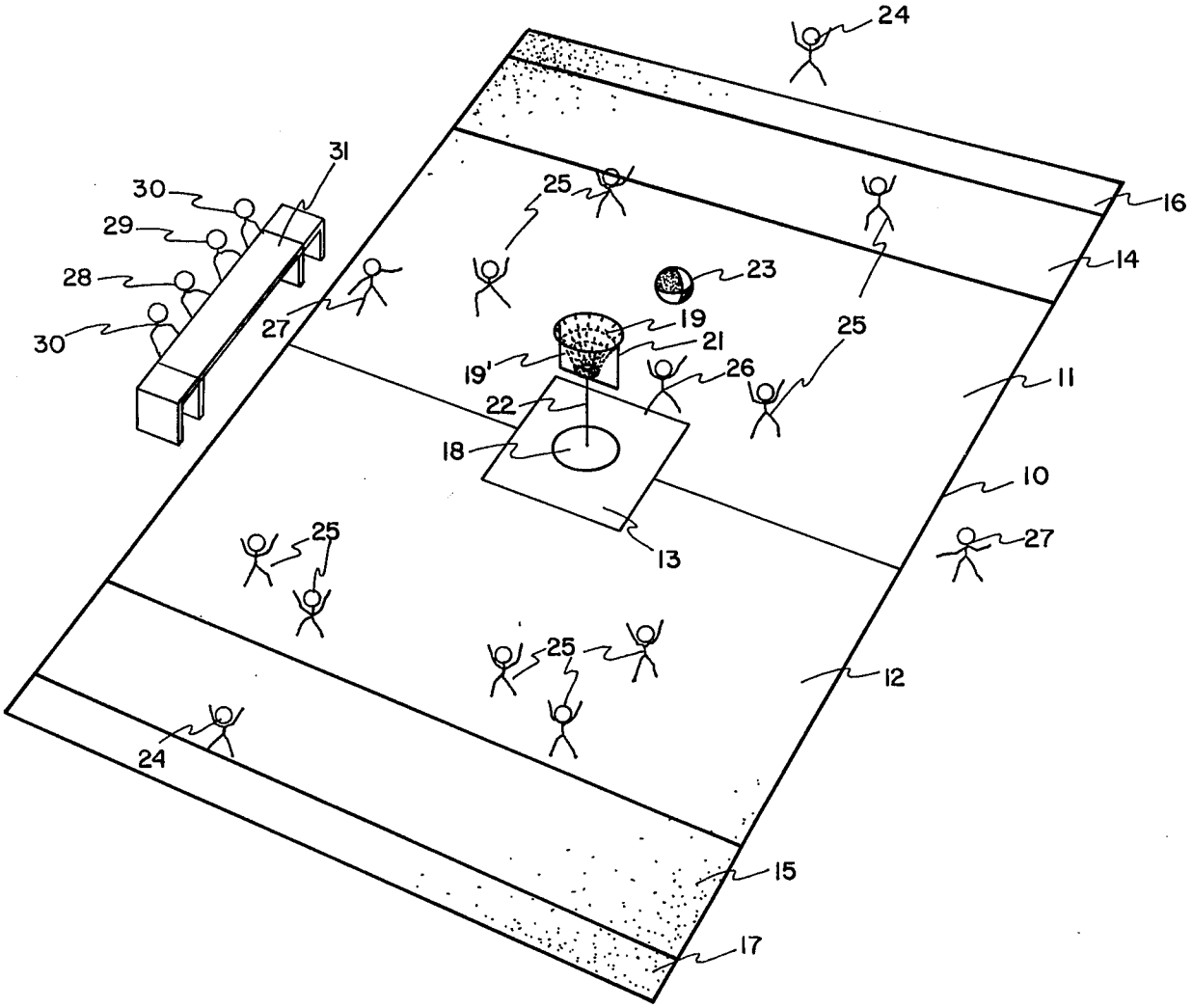
16
14
11
10
27
24
25
12
23
26
21
19
13
15
17
25
19'
22
18
25
31
27
25
30
29
28
30
24

TIP BALL GAME

FIELD OF INVENTION

This invention relates to athletics and more particularly to a unique court type game.

BACKGROUND OF INVENTION

Over the years sport type games have been developed such as basketball, football, volleyball and soccer. Each of these games have their own rules and regulations and although almost any size person can play the same if grouped with other people approximately the same size, to excel in any of these sports, you must have special abilities or physical features. To exemplify this, basketball players must be exceptionally tall as well as agile to excel, football players, on the other hand, must be large and have special skills depending on the position played. Volleyball requires great speed and agility as well as requiring other special skills. Finally the game of soccer requires speed on foot and great stamina as well as agility in footwork. Because of all of these specialized requirements for the various games played, a person who is outstanding in one in all likelihood would not be exceptionable in the others and certainly very few people excel in two much less all of these various sports.

BRIEF DESCRIPTION OF INVENTION

After much research and study into the above-mentioned problems, the present invention has been developed as a team sport that combines many elements found in the sports enumerated above. The game is designed to be played both indoor and outdoors with limited equipment, it is played in such a manner that it gives a small person as much of a chance as a large person thereby making the game one of universal participation.

The game itself is played on a marked court approximately 84×50 feet with a five-foot wide goal mounted at eight feet above the center thereof. The rules have been meticulously worked out and are set, forth in detail.

In view of the above, it is an object of the present invention to provide a sport type game which incorporates basic skills and movements from other sport type games to provide a unique and improved game for participants having varying skill and stature.

Another object of the present invention is to provide a new game in which physical size is not determinative of participation or lack of participation.

Another object of the present invention is to provide a new game which can be played either indoors or outdoors with limited equipment.

Another object of the present invention is to provide a game which utilizes the total athletic skills of the participant.

Another object of the present invention is to provide a new sport type game which incorporates basic features from other sports thereby providing familiarity to portions of the new game by the participants.

Another object of the present invention is to provide a court type game having a centrally disposed hoop used in conjunction therewith.

Another object of the present invention is to provide a new game utilizing a ball having a diameter of approximately 26 inches and used in conjunction with a centrally disposed hoop type goal.

Another object of the present invention is to provide a new game which teaches the participants skills, coordination, agility, speed and body control.

Another object of the present invention is to provide a new game which contributes towards maintenance of total fitness of the individual participants.

Another object of the present invention is to provide a new game which teaches its participants cooperation with others, sportsmanship, respect for rules, and competitive attitudes.

Other objects and advantages of the present invention will become apparent and obvious from a study of the following description and the accompanying drawings which are merely illustrative of such invention.

BRIEF DESCRIPTION OF DRAWING

The FIGURE is a perspective view of the tip ball court of the present invention.

DETAILED DESCRIPTION OF INVENTION

With further reference to the drawing, the tip ball game of the present invention includes a tip ball court 10 which has two volley areas 11 and 12 with a goalie box 13 in the center thereof. Just beyond each of the volley areas 11 and 12 is provided free-tip zones 14 and 15, respectively. Just beyond the free-tip zones 14 and 15 are backman boxes 16 and 17.

To more clearly illustrate the size of the tip ball court 10, it is preferably 50 feet wide with an overall length of 84 feet. The volley areas are each 25×50 feet, the free-tip zones are 12×50 feet and the backman boxes are each 5×50 feet. The goalie box is 13 feet square with the gold area 18 having a diameter of 5 feet.

The goal 19 is preferably formed from a mesh fabric 19' supported by a rim 20. This rim in turn is supported by rim arms 21 on opposite sides thereof which are fixedly secured to rim column 22. This rim column is mounted in the center of tip ball court 10 by any suitable manner. Since the mounting of columns of this type are well known to those skilled in the art, further detailed discussion of such mounting is not deemed necessary.

The goal 19 is preferably 5 feet in diameter with rim 20 being disposed 8 feet above the surface of court 10. If the rim column 22 is 5 feet high, then rim arms 21 will add another 3 feet thereto which will give adequate clearance for the ball to clear the net portion 19' of the goal 19.

The tip ball 23 itself is preferably 27 inches in diameter, is inflated to 7 psi and has a total weight of 12 ounces. This ball preferably includes panels of different colors or shades as can clearly be seen in the drawing.

The players of the tip ball game are illustrated schematically in the drawing and include a backman 24 shown in each of the respective backman boxes 16 and 17. Tippers are indicated at 25, there being preferably 5 tippers on offense and 4 on defense. One goalie 26 plays in the goalie box 13 for the defensive team as will hereinafter be set forth in greater detail. Thus it can be seen that there are 6 players on each side, a backman and 5 tippers on offense and a backman, 4 tippers and a goalie on defense.

It is to be understood, of course, that during actual play the tippers from both teams will be in both volley areas 11 and 12 and, therefore, defensive and offensive players have not been hereinabove specifically designated.

In addition to the above, two officials 27 are used in connection with the tip ball game as is a timer 28, a counter 29, and two scorers 30. These last mentioned persons are preferably seated at an official's table 31.

The following relates to playing of the game of the present invention:

DEFINITIONS

Tie-up—When two opponents have one or both hands firmly on the ball neither can gain possession.

Save—When the goalie or another player catches a spike or a tip attempt.

Block—when the goalie or another player bats away a spike or a tip attempt.

Tag—When the defensive player knocks the ball from the hands of the offensive player. Defensive players can tag the hand but cannot tag above the wrist, or impede the offensive players progress.

Force play—When the offense has used all of its passes and is forced to tip or spike the ball.

Turnover—The ball touching the floor due to an error in passing or catching.

Slugging—Defensive player using a closed fist to make a tag.

Tipover—Ball being spiked or tipped over the hoop.

Passover—Offensive goalie catching the ball after a tipover and passing it back over the hoop for a tip, spike, or start play again.

Delay of Game—Offensive player touching the ball after a tag, or turnover preventing the defense from putting the ball in play.

Spiking—Jumping as high as possible and forcefully hitting the ball down into the hoop.

Rebound—A spike or a tip being blocked or the ball touching the rim of the hoop, coming back into play.

Lob—Offensive player throwing the ball in the air to a teammate to set up a tip or a spike.

Freeze—The attempt by the leading team in a game to maintain possession of the ball and run out the clock. This is legal the last two minutes of each half.

Illegal Freeze—The leading team freezing the ball before the last two minutes of each half.

Palming—If a player is tipping the ball and it rests momentarily in his hand or hands, it is considered an illegal tip. The same rule is in effect for the spike.

Self-tip—Holding the ball in one hand and batting it away with the other.

Jump Spike—Player holding the ball in one hand, jumping in the air and forcefully hitting the ball down into the hoop with the other hand. Players using the jump spike will need to use the head and shoulder fake. It will be very hard to jump spike on a goalie one on one so the fake will be very important in using the jump spike. The reason for the fake is to set the goalie in the air so the tipper can move to either side to get off an uncontested jump spike.

Log Spike—Offensive player throwing the ball in the air to a teammate to set up a tip or a spike. The ball should be lobbed between the goalie's box and the offensive player so the defense cannot intercept or block the spike.

Backman—The backman should be the best long tipper on the team. He is like a quarterback or a point guard. He calls all the offensive plays and should be the floor counter. He would probably be the shortest and fastest player on the team.

Wingmen—Wingmen are the quickest and the best leapers of the tippers. He has to have good speed and master the art of lob spiking. His functions on offense are to get free for the lob and be able to pass off as quick as possible when he is covered. They also need to be good long tippers.

Forwards—The forwards are the power players on the team. They set good screens and master the art of the jump spike. They are the tallest and strongest players, but their main function is to free the backman and the wingmen for lob spikes. They should also master the art of lob passing.

Goalie—When a goalie is on offense he has to make sure that he catches the ball on a tipover. His function on offense is to catch the ball and be able to make a good passover or just put the ball in play.

POSITIONS AND FUNCTIONS

A. Backman

1. The backman never goes across the court to play defense.

2. When the opponents get the ball, the backman has to go to the two point area (backman's box).

3. When the ball is passed to the backman to start play, he cannot go out of the box to receive the pass. After he has received the pass he can run the ball out but if he wants to take a one or two point tip another player will need to touch the ball first.

4. The backman does not need to touch the ball after points have been scored by the other team.

5. A team can change backmen on every play, no special player has to be the backman.

6. If the defense tries to prevent the backman from receiving the ball, the backman can step out and another player can step in and receive it or a player can run from the defensive side into the backman's box. After the turnover, tag or steal or the save or block, only one player can be in the box for the first pass or run in.

7. After the ball is received in the backman's box a team has five seconds to get it in play.

8. A team has eight seconds to get the ball in the backman's box after it crosses mid-court.

9. The only time the ball needs to go in the backman's box is after a steal, tag, or a turnover, also a save or a block.

B. Goaltender or Goalie

1. The goalie can catch or tip the ball away from the goal when it is on it's way up or down.

2. The goalie can either pass or tip the ball to his backman when he makes a block or save.

3. The goalie has to stay in the goalie's box at all times. The only time he can come out is when his momentum carries him out after making a save or a block.

4. When the goalie is attempting to block a spike, the ball must make contact with the player's hand before the goalie can block it.

5. If the goalie makes contact with an offensive player while he is in the act of spiking, the player gets three points and a free play. If he is not in the act of tipping, he gets one point and a free play.

6. If the defensive goalie steps out of the box to make a play, the offense will get a free play. If the offensive goalie steps out of the box, the ball will go to the defense and they will get a free play.

7. The goalie can never score points but he can assist his teammates by lobbing the ball over the basket when he catches it on a tip-over. After he catches it on a tip-over, he has five seconds to get it in play.

8. When the offensive team tips the ball after the last pass, the goalie (offense) cannot touch it. If he does the ball goes to the other team.

9. On a pass-over, if the defensive goalie intercepts the pass from the offensive goalie and his momentum carries him out of the goalie box, the ball goes to the offense again.

C. Tippers—Defense

1. Defensive tippers or player's main function is to try for the tag and force the pass. Since the five pass rule is in tip ball, the most important defensive play is to force the pass.

2. Defensive players can never make a defensive play in the goaltender's box. Free play and points are goofs if it's a block or a save.

3. Defensive players can never make a tag when the offensive player is in a tipping or spiking motion. Free play and the points are awarded according to the position on the floor.

4. Defensive player can never block a tip or a spike until the ball has made contact with the offensive player's hand. Free play and points awarded.

5. When a defensive player gets possession of the ball due to a steal, tag, turnover, block or serve, he gets the ball to his backman as soon as possible.

6. When a defensive player makes a tag, he must not tag above the offensive player's wrist or impede his progress.

7. Only four defensive tippers are allowed to play defense on five offensive tippers.

8. Defensive tippers cannot go in the backman's box on the first pass after a steal, tag or a turnover. After the ball has been passed out and goes in again, the defense can go in to make a block or a tag.

9. When the ball is tipped or the offense makes a bad pass and the ball touches the floor. The defense can put the ball in play because the offense can't touch it until the defense has full control of the ball. Full control means the ball being in his hands and he has taken one step.

D. Tippers—Offense

1. No offensive tipper or player can make a play within the goalie's box. Offensive players can run through the box but he only has three seconds to stay in. If he makes contact with the goalie while he is in the box, the opponents will get a free tip. If at the time the offense scores a hoop, the points will not count.

2. When the ball is passed from one offensive player to another offensive player and the pass is dropped, it's a turnover. If it's deflected by the defense and it touches the floor, the offense can pick it up and put it in play. If it's deflected by a defensive player, touched by an offensive player, then touches the floor, the ball belongs to the defense.

3. After each score the ball is taken out in the opponent's backman's box. The official touches the ball first, then the ball is passed in. If it's a violation of a foul, the ball can be passed in from half court on the court or on the side. The ball can also be taken out from the backman's area off the court. After a violation or a foul when the ball is passed in that counts as a pass.

4. The offense is responsible for making the action in the game. If the offense does not make the action in the game and the officials feel they are in an illegal freeze, he will say "play ball". After the official says "play ball", the offense has ten seconds to get off a pass or a tip.

5. After the ball crosses the midcourt line and touches the backman, the offense has five passes before they must take a tip.

6. After the fifth pass, the player that catches the ball will need to tip the ball within ten seconds or the ball will go to the defense. The ball will need to touch the rim, be blocked or saved, or go over the hoop in and touch the other court in order for it to be a good play.

7. When a team is awarded a free play, they have only three passes to get a tip off.

8. When a tipper is attempting a two point tip, he has to be clearly in the backman's box. If his foot touches the line, he will be given one point. When a player is attempting a one point tip and he steps in the volley area, the play will be called dead.

9. In the volley area, the ball must be spiked or lobbed to a teammate for a tip. If the player uses a self-tip in the volley area, the defense will be awarded the ball.

10. Five tippers play defense against four defensive tippers.

11. After a score, the offensive team has five seconds to get the ball in play and eight seconds to get the ball across the half court. If it's a foul or a violation, the offense has five seconds to get the ball in play.

12. In case of a tie-up between the offensive and defensive player, the defense will be awarded the ball.

13. After a spike or a tip has been blocked and the rebound comes back into play, if the offense gets the rebound, they have five more passes. After a free play (foul, three passes) attempt, the ball is blocked and the offense gets the rebound. Regular play will start and the offense has five passes.

14. When the offense attempts a tip or a spike and it is blocked by the goalie or the ball touches the rim, the offense has five more passes. If the block is marked by a defensive tipper and the offense recovers the ball, the count remains the same.

15. When an offensive player attempts a spike of a tip, he cannot touch the line but his momentum can carry him in the goalie's box after he makes the spike or tip. He has to make contact with the ball before he crosses the line. If he makes contact with the goalie, the goalie's team will be awarded a free play.

OFFICIALS

A. Game Officials

1. The officials inspect and approve all equipment. He does not permit any player to wear equipment which in his judgment is dangerous to other players or is unnatural and designed to increase height or gain a similar advantage. He is responsible for notifying each captain three minutes before each half is to begin. He also tosses the coin to give first possession. He also makes sure each team changes courts at the end of each quarter or at half time. He has the power to terminate a player from the game for unsportsmanlike conduct.

2. When the game starts the trailing official should station himself out in the area when he can see the action in the volley area and the backman's box. The leading official should station himself near the hoop. A good position is just across the half court line. He needs to give a signal after each score to let the scorer know the manner of points that was scored. The officials have to make judgment on the offense as to not allow a freeze before the last two minutes of each half. That is a judgment call. The leading official (official near the goal) should be the official to keep up with the count.

B. Counter

1. The official counter should be visible at the scorer's table. In official tip ball and if possible in all games an official counter should be present. It is very important that a count of passes is visible so the offense and defense will know how many passes the offense has left.

2. One member of each team on the floor should be responsible for the count and let the team know verbally. Its as important for the defense as well as the offense to know the count of passes.

C. Timer

The timer has the duty to keep up with the amount of time that has been played, stopping the clock whenever substitutes are made, during fouls, or at other times when the ball is dead.

D. Scorer

One scorer for each team is provided at the official table. In addition to keeping score, their duties include recording substitutes and the like.

RULES OF PLAY

Putting the ball into play at the start of the game is determined by a coin toss. At the start of each succeeding quarter or half or extra period, teams will get by-possession. Example: If the red team wins the coin toss at the start of the game, at the start of the second quarter, the blue team will get the ball. After the half is over the red team will again get the ball, etc.

A player is out of bounds when he touches the floor on or outside a boundary.

The ball is out of bounds when it touches a player who is out of bounds or any other person, the floor, or any object on or outside a boundary.

The ball is caused to go out of bounds by the last player to touch it before it goes out. If the ball is out of bounds because of touching a player who is on or outside the boundary such player caused it to go out.

If the score is tied at the end of the second half, play continues without change of court for one or more extra periods, with one minute intermission before each extra period. In games played in quarters, each extra period is three minutes. In games played in halves, each extra period is five minutes. As many such extra periods are played as are necessary to break the tie. Extra periods are an extension of the second half.

Time-out occurs and the game watch is stopped each time an official blows his whistle, foul violation, tie-ups, any unusual delay in getting a dead ball alive, conference with scorer, timer or counter, and the like. Any player may request a timeout, such request being granted only when the ball is dead or in control of a player of his team and when no change of the ball is about to occur.

The captain is the representative of his team and may address an official on matters of interpretation or information in a courteous manner. Any player may address an official to request a time-out or permission to leave the court.

After the tag, steal or a turnover, the count does not start until after the ball touches the backman.

If the ball goes out of bounds due to a bad pass or catch, the team that puts the ball in play does not need to pass the ball to the backman.

The ball is taken out on their court and the count starts as soon as the pass is made in.

The counter cards should read 5-4-3-2-1-0. The first five cards on the counter should be white background and black numbers. The 0, which means the team is in the force play, should be a solid red card or a red background card with a white 0.

The ball is tipped with an open hand or hands. The ball must never rest on the tipping hand.

If the defense steals, tags or causes a turnover on the offense and the defense gets possession of the ball, if the ball is then stolen, tagged or turned over before it crosses half court the backman does not need to touch the ball because the ball never went in the other court.

When the goalie makes a save, he can turn and throw the ball to his backman. This is the only time the ball is allowed to touch the floor when advancing it.

When the ball is tipped over the hands of both goaltenders and the offense goes across the court and recovers it, they get a new five passes.

When a save or a block and recovery is made, the team has eight seconds to get the ball across half court.

The offense cannot freeze the ball until the last two minutes of each half. The offense must make an honest attempt to score or pass the ball. One person cannot control the ball for a long period of time. If he does and the defense is applying pressure, the official will say "play ball", if the offense does not tip or pass the ball in ten seconds the ball will go to the defense.

When the defense commits an intentional foul to stop the clock, the offense will get one point and a free play.

When an offensive player is near the half court line and he takes a spike or is lobbed the ball for a tip, he can tip the ball on the offensive side and come down on the defensive side. He must be on the offensive side when the ball leaves his hand.

STRATEGY

A. Offense

Tip ball strategy is different from any other team sport. Since the five pass rule is in, the ball should be ran more and passed less. It's very important that each member of the offense screen as much as possible. Even the tipper with the ball has to screen sometimes in order to free a player. Teams should work hard the first two or three passes to get in a two on one situation with the goalie. Since the spike is worth three points that should be the number one objective for the offense.

Tipping and spiking off the lob is very important. A team would not need to master the lob and spike in order to be productive on offense. Even in the two on one situation with the goalie, the ball would need to be lobbed most of the time. Getting the ball to the backman as fast as possible is another strategy that should be employed. Teams with a good long tipper can score the two point goal if the ball gets to the backman fast enough. When a team has used four of the five passes given, they clear out and run a play for two points. Free plays should be ran for the three point play since no goalie is active on defense.

B. Defense

The first defensive strategy in tip ball is to force the pass. In order to force the pass, the defense double team the tipper with the ball whenever possible. Since the offense only has five passes, the defense should try to make them force the first two or three passes. If the offense forces the first two or three passes, they will not have enough passes to set up a three point play.

When guarding the three point play, the important thing to remember is if the goalie is one on one with the tipper do not double team him. Play the tipper with the ball for the lob. He will try to lob the ball to one of his open teammates. It is very difficult for a player to spike on the goalie one on one. Even if the tipper has a height advantage.

PLAYING RESTRICTIONS

Fouls

1. Personal Fouls

A. Kicking, tripping, charging, pushing, holding, or blocking while in motion.

B. Unnecessary roughness or making contact with a player while he is in the act of tipping or spiking the ball.

2. Technical Fouls

A. Making an illegal substitution.

B. Taking more than four time-outs in a half.

C. Either team having more than six men on the court at one time.

D. Unreasonable delay in the game.

E. Unsportsmanlike conduct.

Violations

A. Offensive player passing the ball more than five times in regular play and more than three times in free play.

B. Ball touching the floor while advancing it except for the pass to the backman after a steal, turnover or a tag, block and save.

C. Defender touching the ball before the offensive player makes contact with it while in the act of tipping or spiking.

D. Goaltender touching the basket while attempting to block a tip or make a save.

E. Offensive goaltender catching the ball on a tipover after the last pass, regular play or free play.

F. Offensive player holding the ball more than ten seconds after he has used his last pass.

G. Backman tipping the ball before a teammate has touched it after a tag, steal, turnover, block or a save.

H. Offensive player touching the ball after the ball has touched the floor due to a tag or error in passing or catching the ball.

I. Offensive player using a self-tip inside the volley and spike area.

J. Goaltender coming out of his box to intercept a pass or a lob.

K. Ball resting momentarily in a player's hand while attempting a tip or a spike.

PENALITIES AND THEIR ENFORCEMENT

1. Personal Fouls

A. When a player is fouled in the act of tipping, one point and a free play will be awarded. If a player is fouled and he was not in the act of tipping, the team will be awarded a free play.

2. Technical Fouls

A. When a technical foul is committed, the offense will receive a five pass free play and one point.

VIOLATIONS WITH PENALTIES

A. Goaltender touching the basket while attempting to block a tip. Points will be awarded according to where on the floor the tip or spike came from.

B. Offensive player touching the ball after the ball has touched the floor due to a tag or error in passing or catching the ball. The opponents are awarded a free play. Such a violation is considered as possibly depriving the attacking team of a chance to score and therefore is penalized by a free play.

From the above it can be seen that a highly developed sport type game is provided which combines the better features of basic basketball, football, volleyball and soccer to give the players thereof an opportunity to learn skills, coordination, agility, speed and body control. It additionally contributes towards the maintenance of total fitness of the individuals and teaches respect for others, sportsmanship, respect for rules, and proper competitive attitude.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. The method of playing a ball type sport game comprising: designating an elongated court having ends and a central area; providing a goal means approximately five feet in diameter disposed about eight feet above the middle of the center area; designating areas of said court adjacent its ends as special backman box play areas; designating an area generally in the center of said central area and below said goal means as a special goalie box play area; designating areas adjacent to and between said special backman box play areas and said special goalie box play area as special free tip play areas; designating areas between said special free tip play areas and said special goalie box area as volley play areas; providing rules of game play; and playing a ball type sport type game on said court by said rules whereby an improved

2. The method of claim 1 wherein said elongated court is approximately eight-four feet by fifty feet in size.

3. The method of claim 2 wherein said special backman box play areas are approximately five feet by fifty feet in size.

4. The method of claim 3 wherein said special goalie box play area is approximately thirteen by thirteen feet in size.

5. The method of claim 4 wherein said special free tip play areas are approximately twelve by fifty feet in size.

6. The method of claim 5 wherein said special volley play areas are approximately twenty-five by fifty feet in size.

7. The method of claim 6 wherein said ball used in conjunction with said game is approximately twenty-seven inches in diameter, is inflated to approximately seven psi, and has a total weight of approximately twelve ounces.

* * * * *